US009478852B2

(12) United States Patent
Werner et al.

(10) Patent No.: US 9,478,852 B2
(45) Date of Patent: Oct. 25, 2016

(54) ANTENNA APPARATUS AND COMMUNICATION SYSTEM

(71) Applicant: The Penn State Research Foundation, University Park, PA (US)

(72) Inventors: Douglas H. Werner, State College, PA (US); Zhihao Jiang, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 214 days.

(21) Appl. No.: 14/462,780

(22) Filed: Aug. 19, 2014

(65) Prior Publication Data

US 2015/0054696 A1 Feb. 26, 2015

Related U.S. Application Data

(60) Provisional application No. 61/868,836, filed on Aug. 22, 2013.

(51) Int. Cl.

| | |
|---|---|
| ***H01Q 1/48*** | (2006.01) |
| ***H01Q 1/27*** | (2006.01) |
| ***H01Q 1/52*** | (2006.01) |
| ***H01Q 15/00*** | (2006.01) |

(52) U.S. Cl.

CPC ..... *H01Q 1/48* (2013.01); *H01Q 1/273* (2013.01); *H01Q 1/52* (2013.01); *H01Q 15/0013* (2013.01); *H01Q 15/0086* (2013.01)

(58) Field of Classification Search

CPC .... H01Q 1/273; H01Q 1/48; H01Q 15/0013; H01Q 15/0086; H01Q 1/52

USPC ..... 343/700 MS, 718, 770, 848, 909

See application file for complete search history.

(56) References Cited

U.S. PATENT DOCUMENTS

| | | | | |
|---|---|---|---|---|
| 4,700,197 | A | 10/1987 | Milne | |
| 5,407,075 | A | 4/1995 | Descalzo | |
| 7,450,077 | B2 * | 11/2008 | Waterhouse | H01Q 1/273 343/700 MS |
| 7,461,444 | B2 | 12/2008 | Deaett et al. | |
| 7,592,957 | B2 * | 9/2009 | Achour | H01Q 1/38 343/700 MS |
| 7,629,934 | B2 | 12/2009 | Rhodes et al. | |
| 7,952,526 | B2 * | 5/2011 | Lee | H01Q 1/38 343/700 MS |
| 8,193,973 | B2 * | 6/2012 | Morton | H01P 1/2005 29/600 |

(Continued)

FOREIGN PATENT DOCUMENTS

| | | | |
|---|---|---|---|
| EP | 1630898 | A1 | 3/2006 |
| EP | 2355243 | A1 | 8/2011 |
| KR | 20120094418 | A | 8/2012 |

OTHER PUBLICATIONS

"Flexible and Compact AMC Based Antenna for Telemedicine Applications" Haider R. Raad et al. , IEEE Transactions on Antennas and Propagation, IEEE Service Center, Piscataway, NJ, US, vol. 61, No. 2 (Feb. 1, 2013.

(Continued)

*Primary Examiner* — Tho G Phan

(74) *Attorney, Agent, or Firm* — Buchanan Ingersoll & Rooney PC

(57) ABSTRACT

An antenna includes a first body having an array of resonators; a spacer adjacent to the first body, and a second body adjacent to the spacer such that the spacer is between the first and second bodies. The first body can be configured as an artificial metasurface ground plane and the second body can be configured as a monopole.

20 Claims, 15 Drawing Sheets

(56) References Cited

U.S. PATENT DOCUMENTS

| | | | | |
|---|---|---|---|---|
| 8,208,980 | B2 | 6/2012 | Wong et al. | |
| 8,547,286 | B2 * | 10/2013 | Xu | H01Q 15/0086 343/700 MS |
| 8,624,787 | B2 | 1/2014 | Druyan et al. | |
| 2004/0185924 | A1 | 9/2004 | Hwang et al. | |
| 2006/0109192 | A1 | 5/2006 | Weigand | |
| 2007/0285324 | A1 | 12/2007 | Waterhouse | |
| 2011/0260939 | A1 | 10/2011 | Korva et al. | |
| 2013/0016030 | A1 | 1/2013 | Liu | |
| 2013/0293441 | A1 | 11/2013 | Zhang | |
| 2014/0104136 | A1 | 4/2014 | Werner et al. | |

OTHER PUBLICATIONS

"Utilizing Wideband AMC Structures for High-Gain Inkjet-Printed Antennas on Lossy Paper Substrate" B.S. Cook and A. Shamim, IEEE Antennas and Wireless Propagation Letters, IEEE Piscataway, NJ, US, vol. 12, (Jan. 1, 2013).

"An Embedded On-Body Planar Antenna Using a Low Profile EBG Structure" Hyeongseok Kim, et al. 2013 IEEEE Antennas and Propagation Society International Symposium (Aspursi) IEEE (Jul. 7, 2013).

"An Omnidirectional Electromagnetic Absorber Made of Metamaterials" Qiang Cheng, et al. New Journal of Physics 12 (2010) Institute of Physics Publishing, Bristol, GB, vol. 12, No. 6 (Jun. 1, 2010).

Metamaterials with Multiband AMC and EBG Properties Christopolulos, et al., Loughborough University, Wireless Communication Research Group, Piscataway, NJ, USA, IEEE, vol. 1 (Oct. 4, 2005).

International Search Report for PCT/US2014/051804 dated Oct. 31, 2014.

Written Opinion by the International Searching Authority for PCT/US2014/051804 dated Oct. 31, 2014.

* cited by examiner

ANTENNA APPARATUS AND COMMUNICATION SYSTEM

CROSS-REFERENCE TO RELATED APPLICATIONS

The present application claims priority to U.S. Provisional Patent Application No. 61/868,836, which was filed on Aug. 22, 2013. The entirety of U.S. Provisional Patent Application No. 61/868,836 is incorporated by reference herein.

STATEMENT REGARDING FEDERALLY SPONSORED RESEARCH

This invention was made with government support under Grant No. EEC1160483, awarded by the National Science Foundation. The Government has certain rights in the invention.

FIELD OF INVENTION

The present invention relates to antennas and communication systems that may utilize one or more such antennas for facilitating communication between different electronic devices such as sensors, body monitoring devices, measuring devices, computers, or other communication devices. For example, in one exemplary embodiment a communication device may be configured to be worn by a person for battle field survival, body monitoring, or wearable computing and may include one or more embodiments of the antenna to permit the device to form radio frequency links with other devices.

BACKGROUND OF THE INVENTION

Devices can utilize one or more antennas to help establish a type of communication link. Examples of such devices and/or antennas may be appreciated from European Patent Publication Nos. 1 630 898 and 2 355 243, U.S. Pat. Nos. 4,700,197, 5,407,075, 7,450,077, 7,461,444, 7,629,934, 8,208,980, and 8,624,787 as well as U.S. Pat. App. Pub. Nos. 2004/0185924, 2006/0109192, 2011/0260939, 2013/0293441 and 2014/0104136.

Attempts have been made to try and use different types of antennas for wearable applications, such as a 2.4 GHz band antenna that includes a planar monopole/dipole antenna, an inverted-F antenna, a slot antenna, and a slot antenna with artificial magnetic conducting surface backing. But, such antenna designs have deficiencies that prevent them from being feasible options for such systems. For example, the monopole/dipole antennas direct a large amount of energy that is radiated to a human body, which generates an undesirable high specific absorption rate in the tissue of the human body. The inverted-F antenna and slot antenna designs also have most of the energy radiated toward a particular top half space. These antennas' form-factors are still not compact enough for feasible or practical application with wearable medical devices that can be suitable for being worn by humans or other living animals. Additionally, the inverted-F antenna and slot antennas can suffer from low front-to-back ratio and low antenna efficiency.

SUMMARY OF THE INVENTION

An antenna for a communication device is provided. Some embodiments of the antenna may comprise a first body having an array of resonators, a spacer adjacent to the first body, and a second body adjacent to the spacer such that the spacer is between the first and second bodies. The first body may be configured as an artificial metasurface ground plane and the second body may be configured as a monopole.

A communication system is also provided. The communication system may include a communication management device communicatively connectable to at least one communication device. Each communication device may be comprised of a processor communicatively connected to non-transitory memory and an antenna communicatively connected to the processor for establishing a radio frequency link to the communication management device. The antenna may include a first body having an array of resonators, a spacer adjacent to the first body, and a second body adjacent to the spacer such that the spacer is between the first and second bodies. The first body can be configured as an artificial metasurface ground plane and the second body can be configured as a monopole.

In some embodiments of the communication system, the communication management device is a server, a workstation, a desktop computer, an access point, or a base station. The communication device may be a wearable body monitor, a wearable electronic device that has one or more sensors or one or more detectors, a wearable radio, a wireless monitor, or a type of electronic device that communicates to one or more other devices via at least one radio frequency link.

In some embodiments of the antenna, the first body can be configured as an artificial metasurface ground plane by having the array of resonators backed by a metallic sheet so that radiation to be emitted from the antenna is substantially directed above the antenna. The resonators can be I-shaped resonators or other type of resonators. In some embodiments only the first body may be flexible, only the second body may be flexible, or both the first and second bodes as well as the spacer may be flexible. In some embodiments the first body and/or the second body and/or the spacer may be a planar structure (e.g. substantially flat and of a relatively thin thickness).

In some embodiments of the antenna, a first side of the first body can be attached to the spacer and a first side of the second body can be attached to the spacer. For instance, in some embodiments the first side of the first body can be attached to a first side of the spacer and the first side of the second body can be attached to a second side of the spacer where the second side of the spacer is opposite the first side of the spacer (e.g. the first side of the spacer is a top side and the second side of the spacer is a bottom side).

In some embodiments of the antenna, the spacer can be composed of foam or be structured as a foam spacer. The first side of the first body can be spaced apart from the first side of the second body by at least 0.1 mm (e.g. between 0.1 mm to 1.5 mm, more than 1.5 mm, etc.). The thickness of the spacer may define the distance by which the first side of the body and the first side of the second body are spaced part. A plurality of vias can also be embedded in the first body to electrically connect an artificial metasurface of the artificial metasurface ground plane of the first body to a ground plane of the artificial metasurface ground plane.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of our antenna, systems that utilize one or more embodiments of our antenna, and methods of making and using the same are shown in the accompanying drawings. It should be appreciated that like reference numbers used in the drawings may identify like components.

DETAILED DESCRIPTION OF PRESENT PREFERRED EMBODIMENTS

We have determined that it can be difficult to isolate antennas from extreme loading effects caused by the necessity for mounting them in close proximity to a human body. We have determined that factors that contribute to this difficulty include the fact that there is a direct tradeoff between small form-factor and high isolation requirements such that, when the overall size of an antenna is lowered, the front-to-back ("FB") ratio will also be lower such that more radiation is directed from the antenna into the human body or other animal body to which the antenna is attachable. In addition, we have determined that it can be difficult to obtain good impedance match across a targeted operating band and low ohmic/dielectric losses in the antenna while also permitting the antenna to be fabricated from light weight components that are able to flex or bend to conform to a body. Nevertheless, we were able to develop an embodiment of an antenna that can be made from components that permit the antenna to be attachable to a human or other animal while also permitting effective communication connections to be formed between a device to which the antenna is attached and other devices via a wireless communication connection.

Figure 1A:
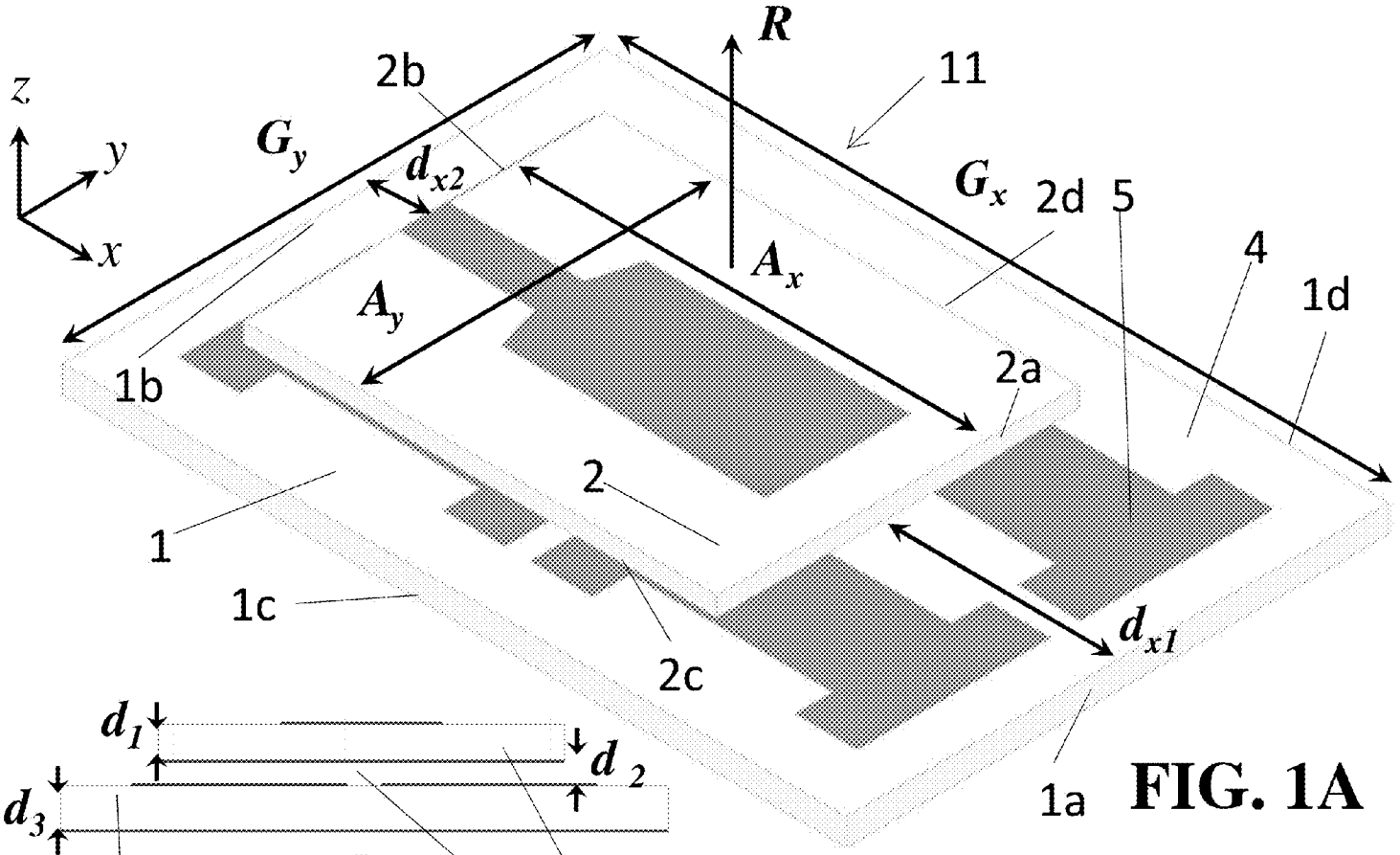
FIG. 1A is a perspective view of a first exemplary embodiment of an antenna.
Figure 1B:
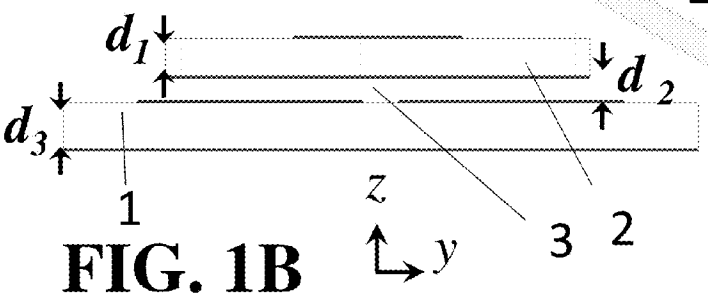
FIG. 1B is a schematic side view of the first exemplary embodiment of the antenna.

Referring to FIGS. 1A-1B, an embodiment of our antenna may be comprised of two sections that are separated by a spacer, such as a foam spacer. The first section 1 may be a flexible planar shaped body such as a flat rectangular plate or flat circular plate that is composed of a flexible or deformable material. The second section 2 may be a second body that is shaped as flexible planar structure such as a rectangular plate or circular plate that has a smaller perimeter than the first section. The second section may be spaced apart from the first section by a spacer 3 such as a foam spacer or other type of spacer suitable for spacing the first and second sections from each other. The spacer 3 may be sized so that the first and second sections are connected to each other by the spacer and are spaced apart from each other by at least 0.1 mm or between 0.1 mm and 1.5 mm.

For instance, a first side of the first section (e.g. a top side of first section 1) may be attached to the spacer 3 such that it faces toward the first side of the first section (e.g. a bottom side of the second section 2). The first side of the first section 1 may be spaced apart from the first side of the second section 2 that faces toward the first side of the first section by a distance that is equal to or is relatively equal to the thickness of the spacer 3. The spacer may be directly attached or otherwise attached to the first sides of the first and second sections via any suitable attachment mechanism such as welding, fastener elements, adhesive, or tape. For instance, a first side of the spacer may be attached to the first side of the first section via an integral attachment mechanism and the second side of the spacer that is opposite the first side of the spacer may be attached to the first side of the second section by an integral attachment mechanism.

The second section 2 of the antenna may be configured as a planar monopole that is configured to be adjacent the top of the first section 1 of the antenna. The first section 1 may be designed to be an artificial metasurface ground plane ("AMSGP") and be positioned below the second section 2. The first section 1 may be configured a an AMSGP that includes a two by two array of I-shaped resonators 5 backed by a continuous metallic sheet 4 that provides a near-zero reflection phase at 2.5 GHz as well as sufficient inductive loading to compensate for the increased capacitance of the antenna due to miniaturization. The metallic sheet may be structured as a ground plane for the first section 1. The configuration of the first section 1 can allow the antenna element of the second section 2 to operate in close proximity to the metasurface of the first section 1 as well as providing a significant reduction in the size of the first section to a size that is about the same as the antenna element of the second section 2 without degrading the input impedance match or decreasing the FB ratio. It can also function as an effective isolation element to minimize the interaction between the antenna and tissue of an animal that may be located directly underneath the first section 1.

It is contemplated that in other embodiments of our antenna different types of resonators 5 may be used for the first section 1. For instance, resonators shaped as symmetric or asymmetric crosses, resonators having pixelized isolated patterns, or patterns with arbitrary but designed curvilinear periphery may be utilized.

The length x, width y, and thickness z (or height) of the first section 1, second section 2 and spacer 3 may be any of a number of different suitable dimensions to meet a particular set of design criteria. In some embodiments, the spacer may have a thickness z that is configured so that a space $d_2$ between the first side of the first second 1 and the first side of the second section 2 are spaced apart from each other by 0.5 mm to 1.5 or by a distance that is greater than or equal to 0.5 mm. In some embodiments, the thickness of the second section 2 may be a dimension $d_1$ and the thickness of the second section may be a dimension $d_3$ as can be seen from FIG. 1B. The length $A_x$ of the second section 2 and the width $A_y$ of the second section 2 can be any of a number of suitable dimensions as well. The length $G_x$ and width $G_y$ of the first section 1 can also be any of a number of suitable dimensions. The spacer 3 can be attached to or otherwise positioned on the first section 1 so that a first end of the spacer is a first distance away from the corresponding first end 1*a* of the first section about the length of the first section. A second end of the spacer 3 that is opposite the first end of the spacer can be positioned a second distance away from the corresponding second end 1*b* of the first section about the length of the first section 1 as well. The spacer 3 can be sized and configured to have a comparable width and length to the second section 2 or may be of sized and configured to have a lesser width and length than the second section 2. In yet other embodiments, it is contemplated that the spacer 3 can be sized and configured to have a length and width that is larger than the length and width of the second section 2 while also having a length and width that is smaller than the length and width of the first section 1.

The second section 2 can be positioned adjacent the first section 1 and above the first side of the first section such that a first end 2*a* of the second section 2*a* is a first distance $d_{x1}$ inwardly from the first end of the first section 1*a* about the length of the first section 1. The second end of the second section 2*b* can also be a different second distance $d_{x2}$ inwardly from the second end 1*b* of the first section 1 about the length of the first section. The first and second sides 2*c*, 2*d* of the second section can also be positioned inwardly of first and second sides 1*c*, 1*d* of the first section by distances along the width of the first section. Those inward width distances can be the same distance or may be different distances.

Embodiments of the antenna may include a first section that is configured as some other type of planar monopole that is shaped as a rectangle, triangle, or ellipse that can be fed by either a microstrip or a coplanar waveguide transmission line.

We have also determined that by tuning the geometrical dimensions of the first and second sections as well as the spacing between them that may be provided by the spacer 3, a highly efficient, low profile antenna can be provided at a target of between 2.36 and 2.4 GHz medical Body Area Network ("BAN") band for certain exemplary embodiments of our antenna. It should be understood that the BAN band is a 40 MHz spectrum that the FCC approved for allocation for medical BAN low power, wide area radio links at the 2360-2400 MHz band. It should also be understood that the BAN band provides for a 2360-2390 MHz frequency range that is available on a secondary basis and may be restricted to indoor operation at health-care facilities under current FCC rules whereas use in the 2390-2400 MHz band may be permitted to be used in all areas including residential under current FCC rules.

In one embodiment of our antenna, the total form factor may be 62 mm×42 mm×3.5 mm (e.g. $0.5\lambda\times0.3\lambda\times0.03\lambda$, where $\lambda$ is the wavelength determined by $\lambda=c/f$, where c is the phase speed of the wave and f is the frequency of the wave). Such a form factor is smaller than any previously proposed state of the art ("SOA") wearable antenna that we are aware of. Further, in contrast to conventional designs where a metasurface acts as an in-phase or high-impedance artificial magnetic conducting ("AMC") ground plane, the finite sized AMSGP first section can act as a primary radiator that operates like a three element slot array with amplitude tapering, which can give rise to a relatively high FB ratio compared to its size.

We built and tested an embodiment of our antenna to be structured similar to the embodiment shown in FIGS. 1A-1B, the embodiment that we built was construed from an integrated metamaterial-enabled small form-factor antenna that was fabricated and characterized. The first section 1 had a form-factor of 62 mm×42 mm×1.5 mm. The second section 2 had a form-factor of 39 mm×30 mm×1.5 mm. A Rogers RO3003 high frequency circuit board was used as the dielectric substrate for both sections. 0.017 mm thick copper was used for the I-shaped metallic resonators 5, the solid ground plane of the first section, as well as the monopole antenna of the second section. A foam layer with a thickness of 0.5 mm was used as the spacer 3. The $S_{11}$ measurement was performed by soldering the input port of the antenna to a standard SubMiniature version A ("SMA") connector and then connecting it to a network analyzer via a 50 Ohm coax cable. The radiation pattern measurements were carried out in an anechoic chamber with an automated antenna movement platform.

As can be seen from FIGS. 2-8, measured results taken from testing of our fabricated embodiment of the antenna showed strong agreement with simulation predictions created for this embodiment. The simulation of the antenna was performed using a computer having the Ansoft high frequency structure simulator, a full-wave numerical software package that is commercially available and is widely used in electromagnetic design.

Figure 2:
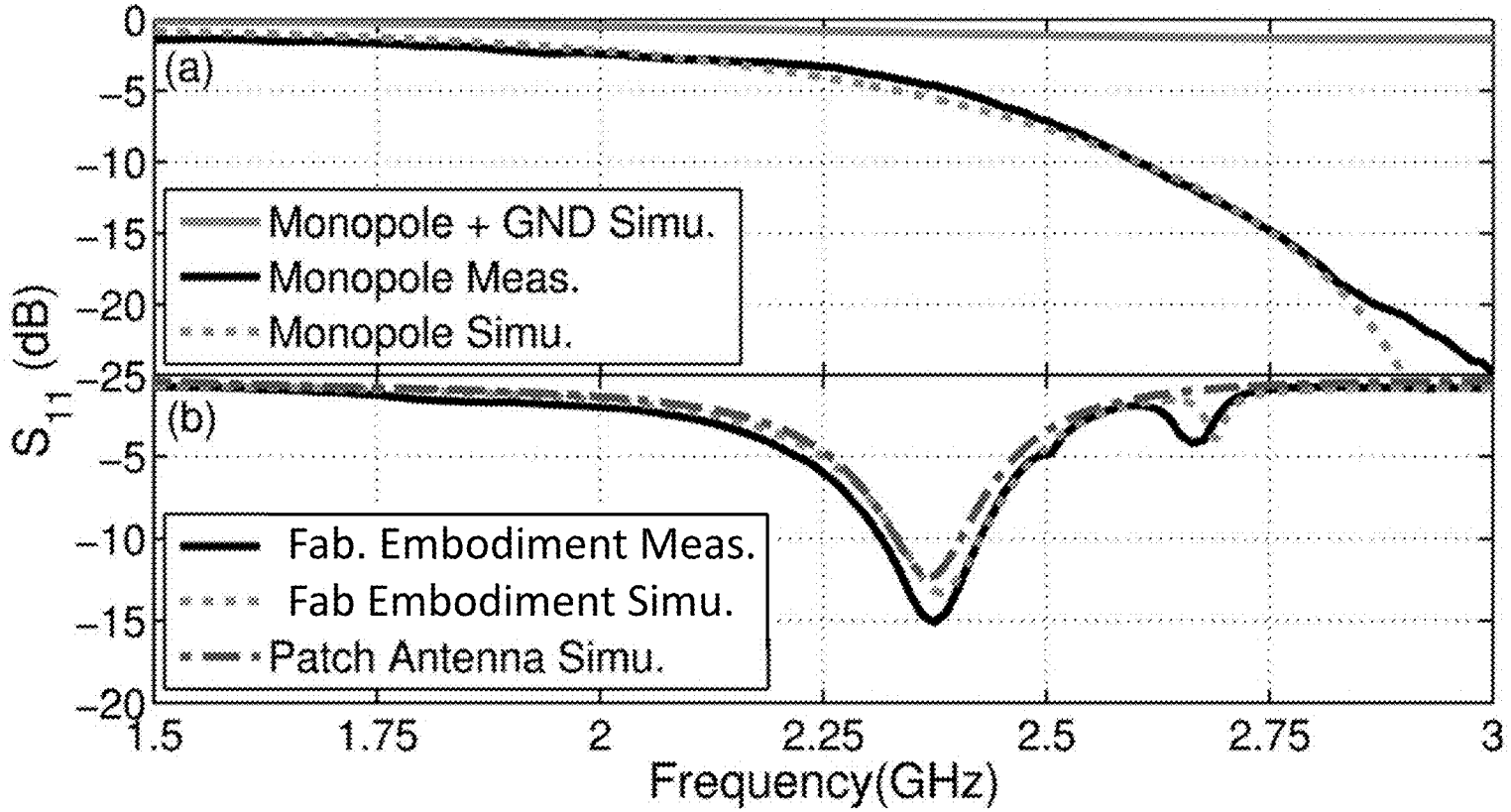
FIG. 2 is a graph illustrating a simulated and measured return loss ("$S_{11}$") of a conventional monopole (Monopole Meas. and Monopole Simu.), simulation of a conventional monopole and ground assembly (Monopole+GND Simu.), simulation of a conventional patch antenna (Patch antenna Simu.) and a fabricated embodiment of our antenna. It should be appreciated that the return loss $S_{11}$ is a measure of how much power is reflected from a transmitter to an antenna. $S_{11}$ may be measured in any of a number of standard ways. For example, $S_{11}$ of an antenna may be measured by connecting an input port of the antenna to a network analyzer through a 50 ohm (Ω) coax cable.
Figure 3:
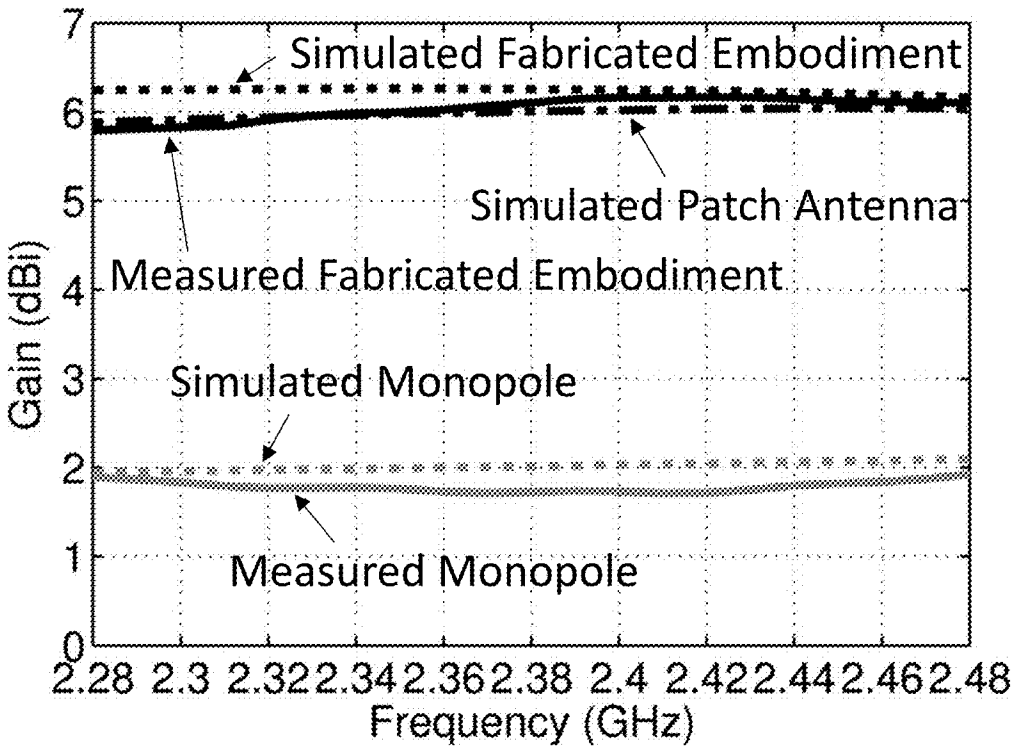
FIG. 3 is a graph illustrating results from a simulation and direct measurement of a conventional monopole, simulated and patch antenna, as well as a simulation and measurement of a fabricated embodiment of our antenna.
Figure 4:
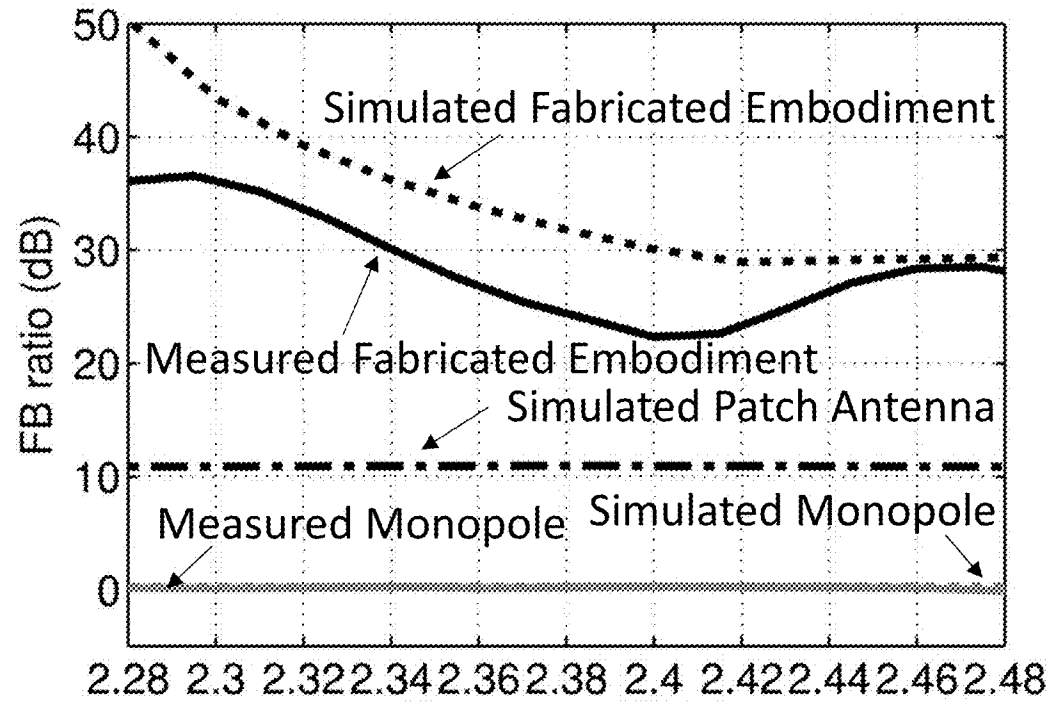
FIG. 4 is a graph illustrating results from a simulation and direct measurement of a conventional monopole, simulation of a conventional patch antenna, as well as a simulation and measurement of a fabricated embodiment of our antenna.
Figure 5:
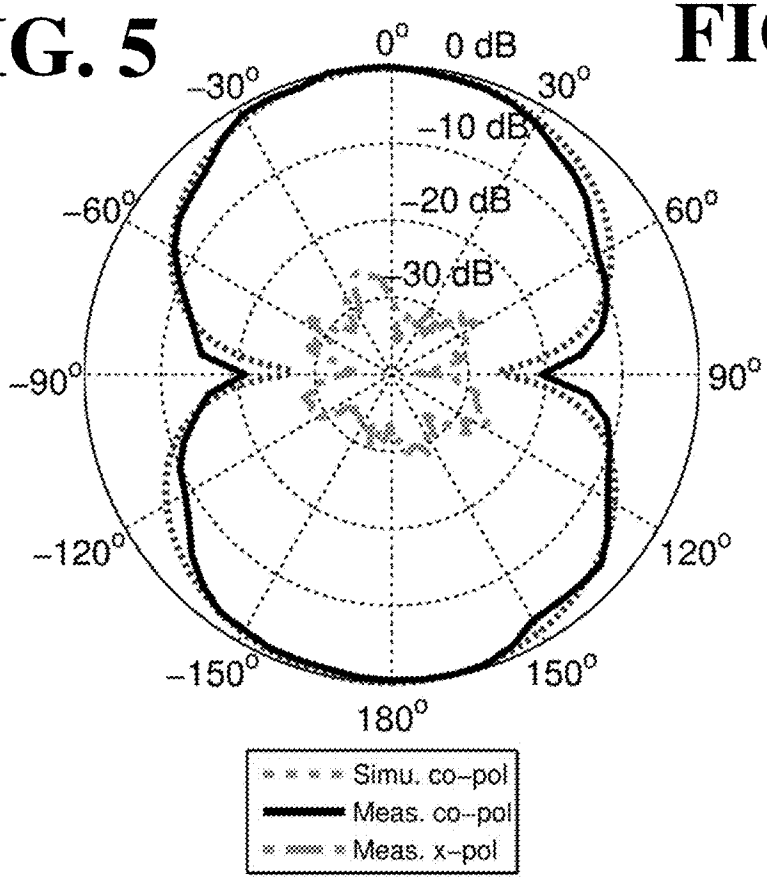
FIG. 5 is a graph illustrating simulated (e.g. Simu.) and measured (e.g. Meas.) normalized radiation patterns from a conventional monopole in the E-plane at 2.38 GHz.
Figure 6:
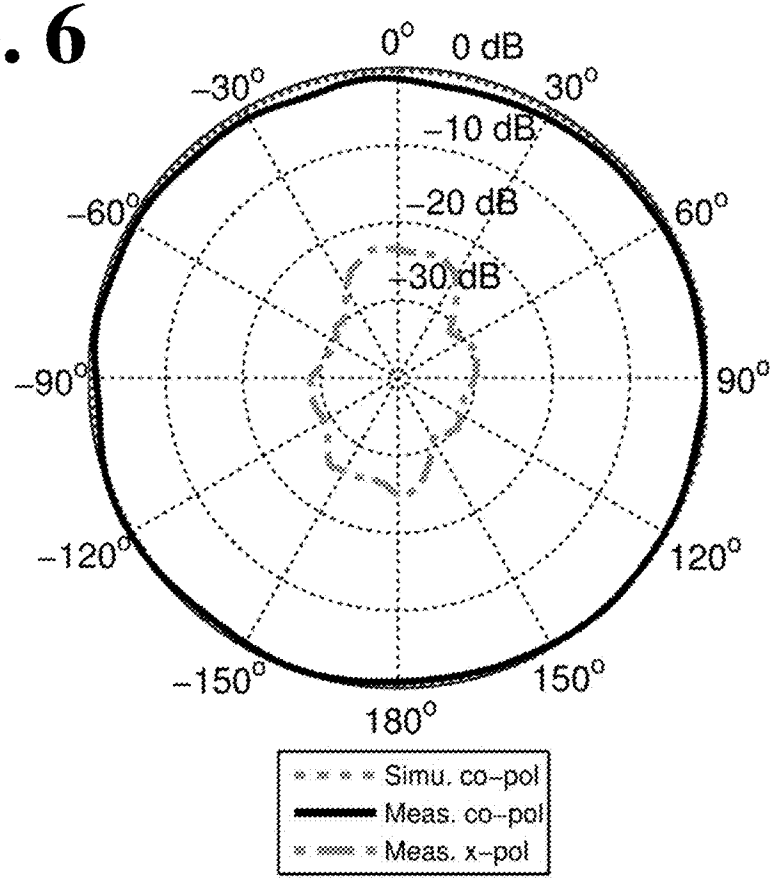
FIG. 6 is a graph illustrating simulated (e.g. Simu.) and measured (e.g. Meas.) normalized radiation patterns from the conventional monopole in the H-plane at 2.38 GHz.
Figure 7:
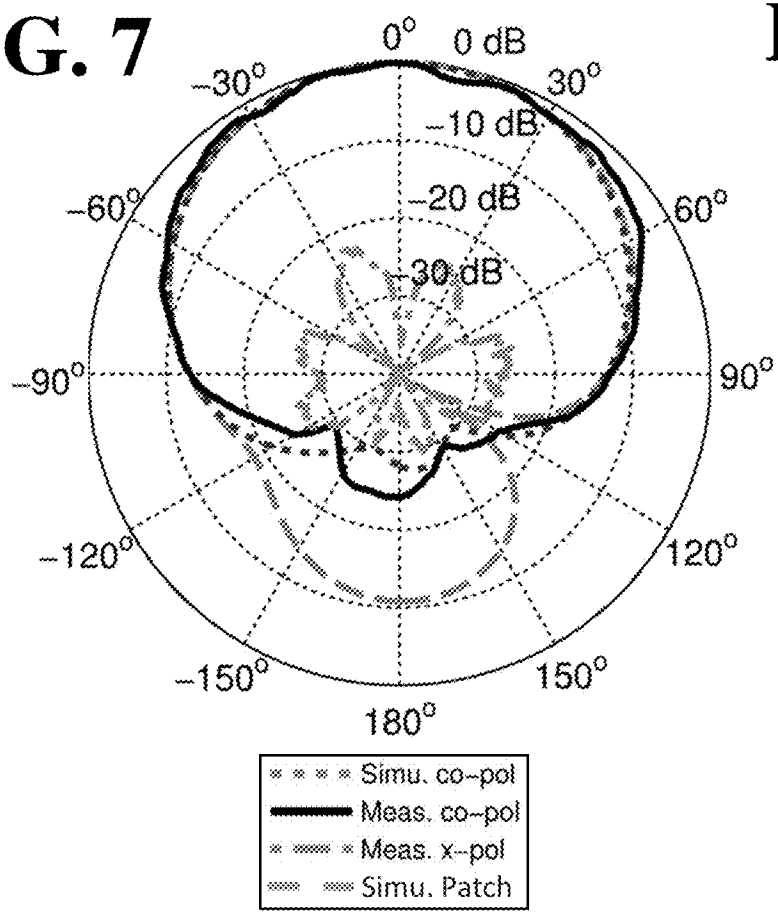
FIG. 7 is a graph illustrating simulated (e.g. Simu.) and measured (e.g. Meas.) normalized radiation patterns for our fabricated embodiment of our antenna in the E-plane at 2.38 GHz along with simulation results for a conventional patch antenna (Simu. Patch).
Figure 8:
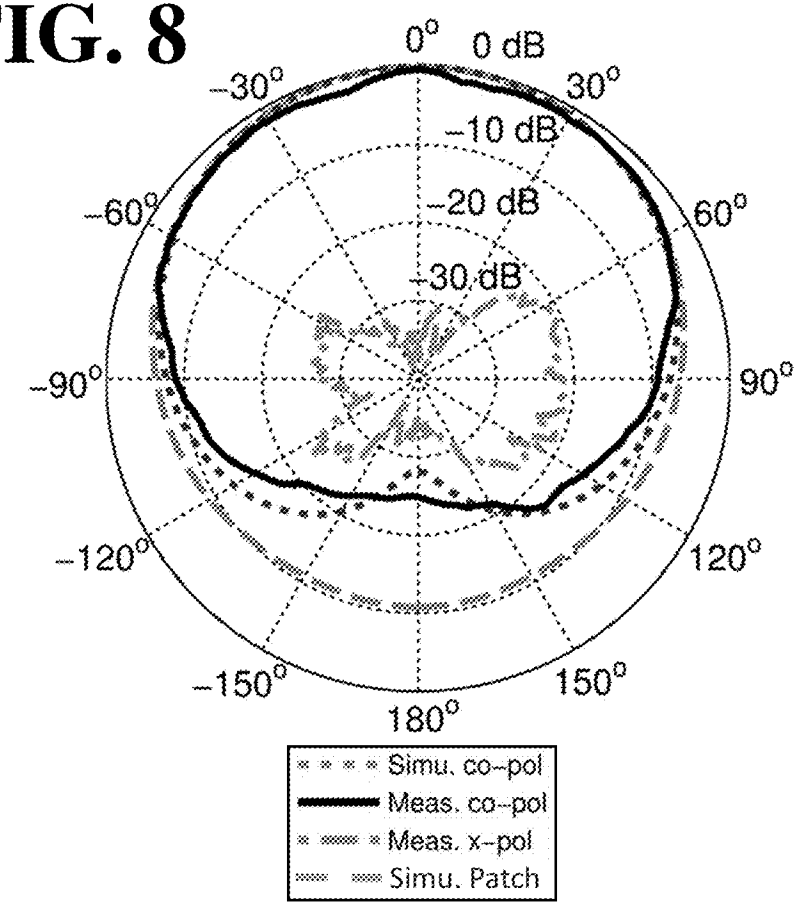
FIG. 8 is a graph illustrating simulated (e.g. Simu.) and measured (e.g. Meas.) normalized radiation patterns for our fabricated embodiment of our antenna in the H-plane at 2.38 GHz along with simulation results for a conventional patch antenna (Simu. Patch).

As may be seen from FIG. 2, the input impedance of the fabricated embodiment of the integrated antenna achieves a band over which $S_{11}$ is less than −10 dB from 2.32 to 2.42 GHz. A comparison of the simulated and measured antenna gain is shown in FIG. 3. The conventional monopole provides a gain of about 2 decibel isotropic ("dBi"), whereas the embodiment of our antenna that we fabricated had a gain of about 6 dBi. The radiation of the conventional monopole is nearly omnidirectional as may be appreciated from FIGS. 5-6 such that a significant amount of radiation from this monopole will enter a human body or other body if that antenna is used in a wearable configuration. As may be seen from FIGS. 7-8, however, the radiation of the fabricated embodiment of our antenna is concentrated mostly in the half space above the antenna (e.g. direction R shown in FIG. 1A) and has an FB ratio exceeding 24 dB, which indicates a robust antenna performance when it is placed on a human body or other animal body or placed very close to such a body to be worn by an animal. The specific absorption rate ("SAR") for the embodiment of our antenna that was fabricated was determine to be about 90 times smaller than that for a conventional monopole having the same input power level as the embodiment of our antenna.

Figure 9:
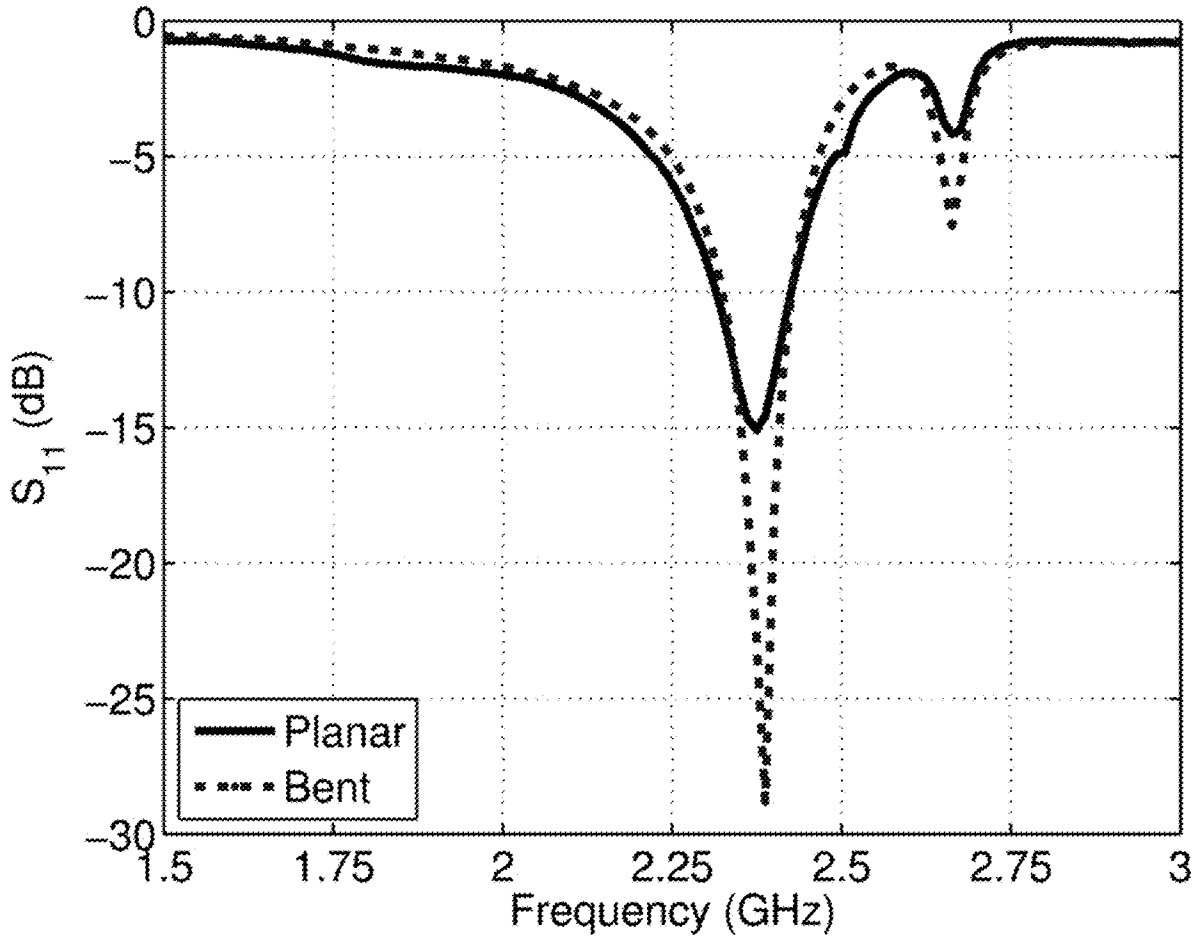
FIG. 9 is a graph illustrating simulated and measured results of the fabricated exemplary embodiment of the antenna curved in free space (e.g. bent) and being positioned flatly, or in a planar fashion.
Figure 10:
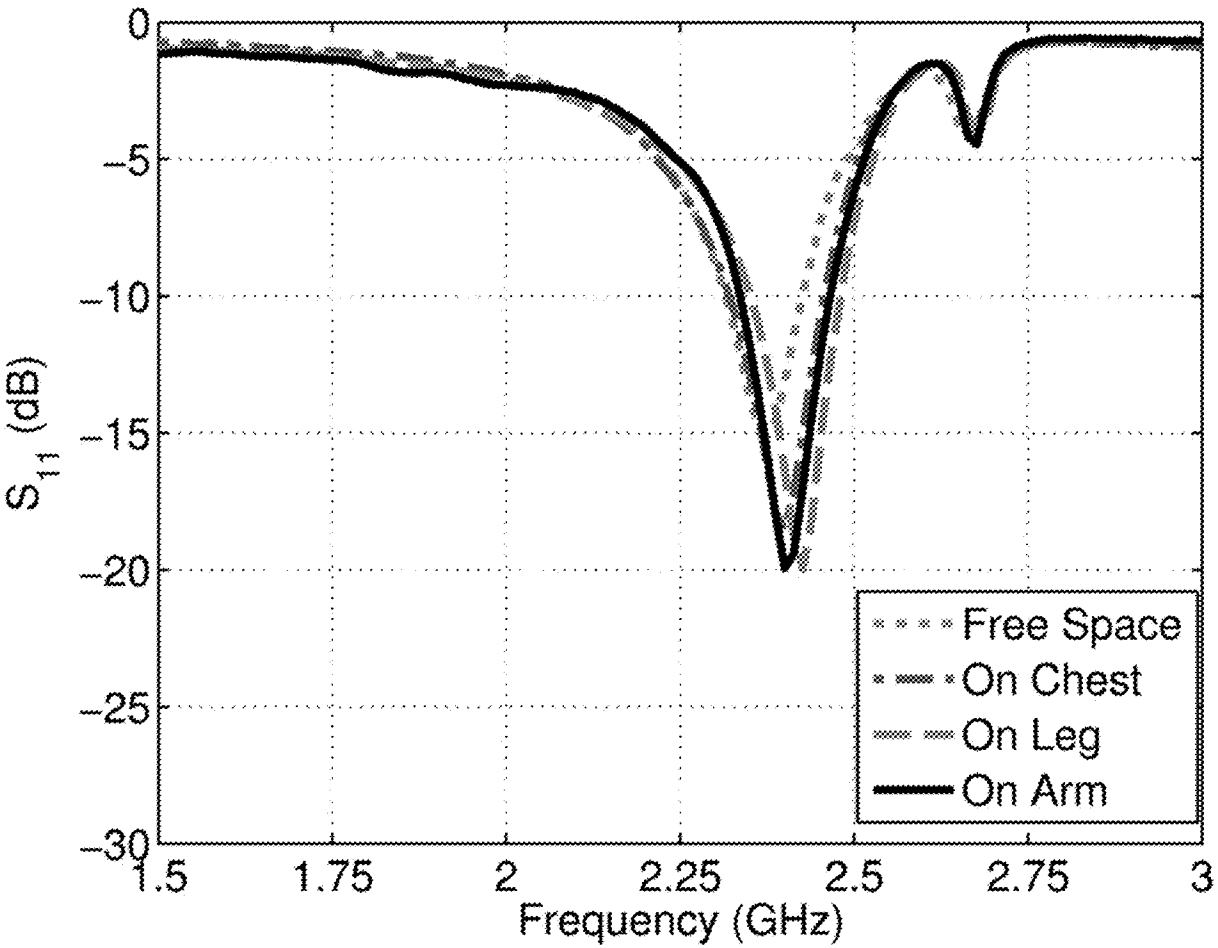
FIG. 10 is a graph illustrating simulated and measured $S_{11}$ of our fabricated exemplary embodiment of the antenna conformed to different parts of a human body (e.g. positioned on the leg, on the chest, on an arm,) as well as being positioned in free space.
Figure 11:
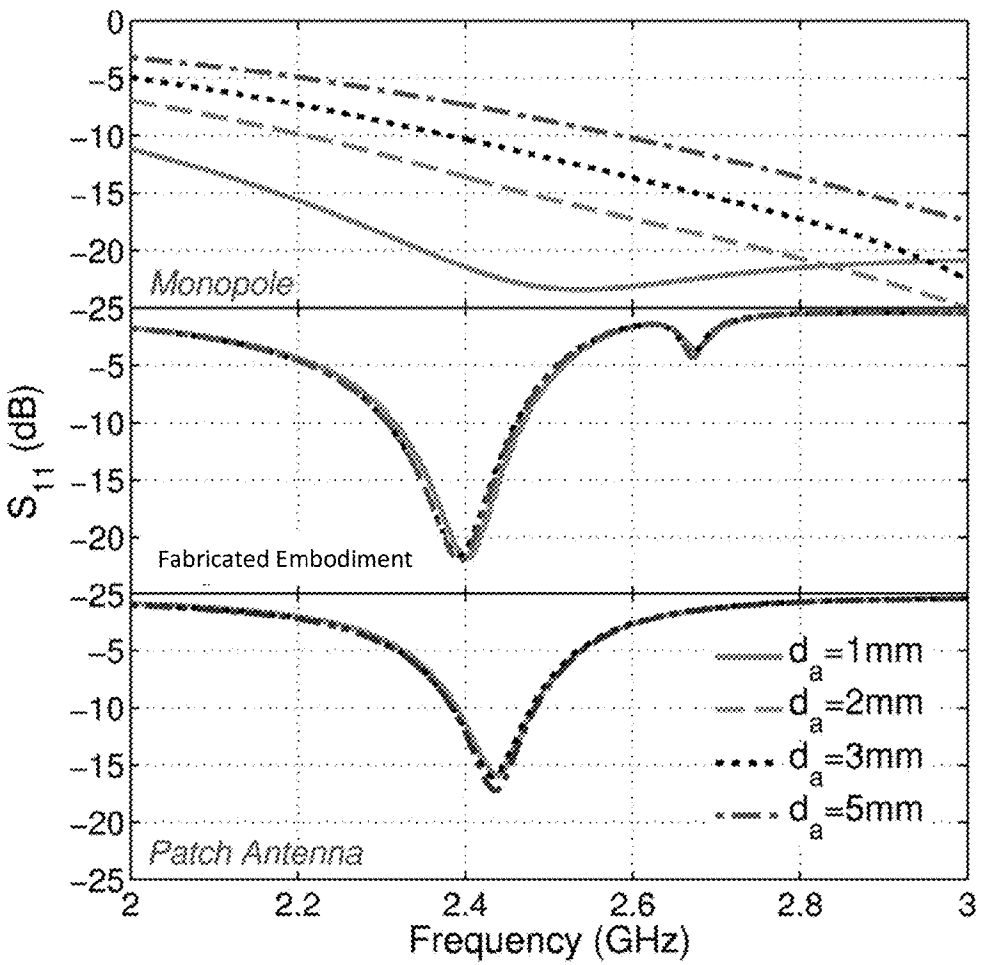
FIG. 11 is a graph illustrating $S_{11}$ determined to exist for an embodiment of our antenna, a reference patch antenna, and a planar monopole antenna.
Figure 12:
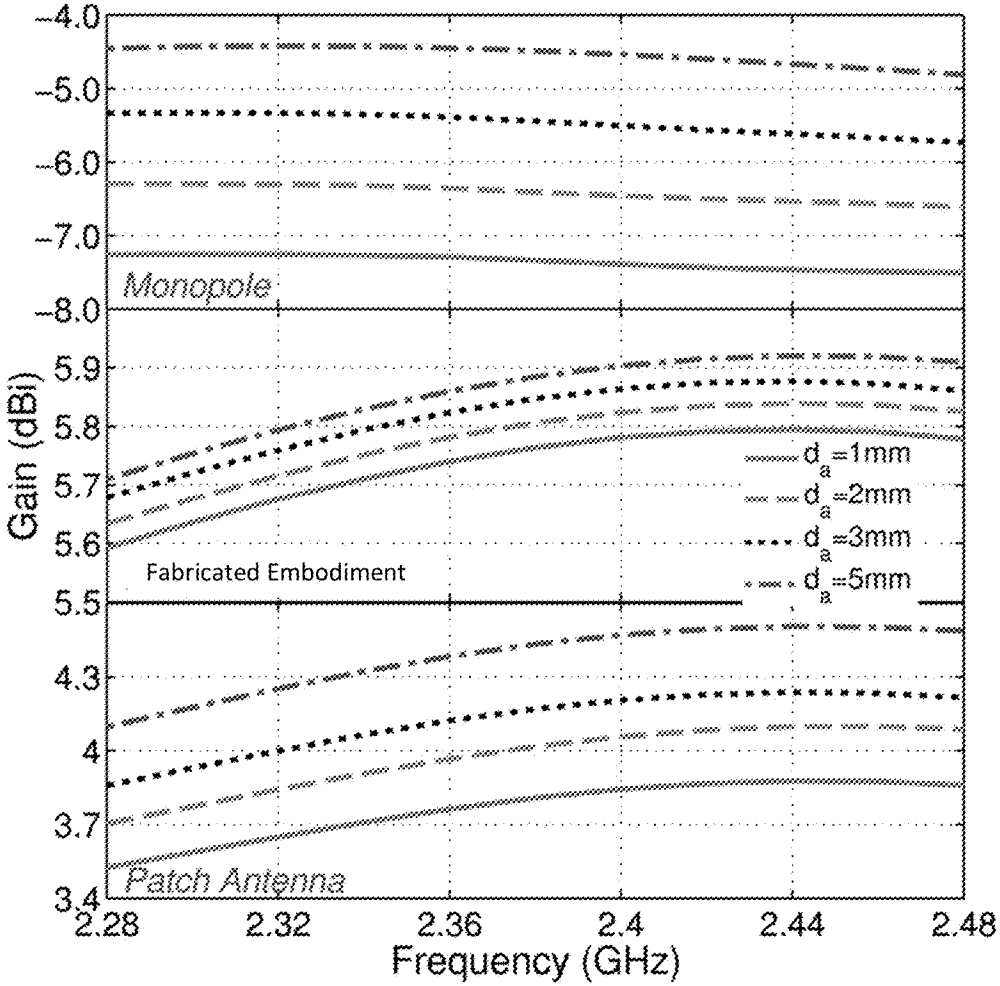
FIG. 12 is a graph illustrating the gain between an embodiment of our antenna, the reference patch antenna, and the planar monopole antenna.
Figure 13:
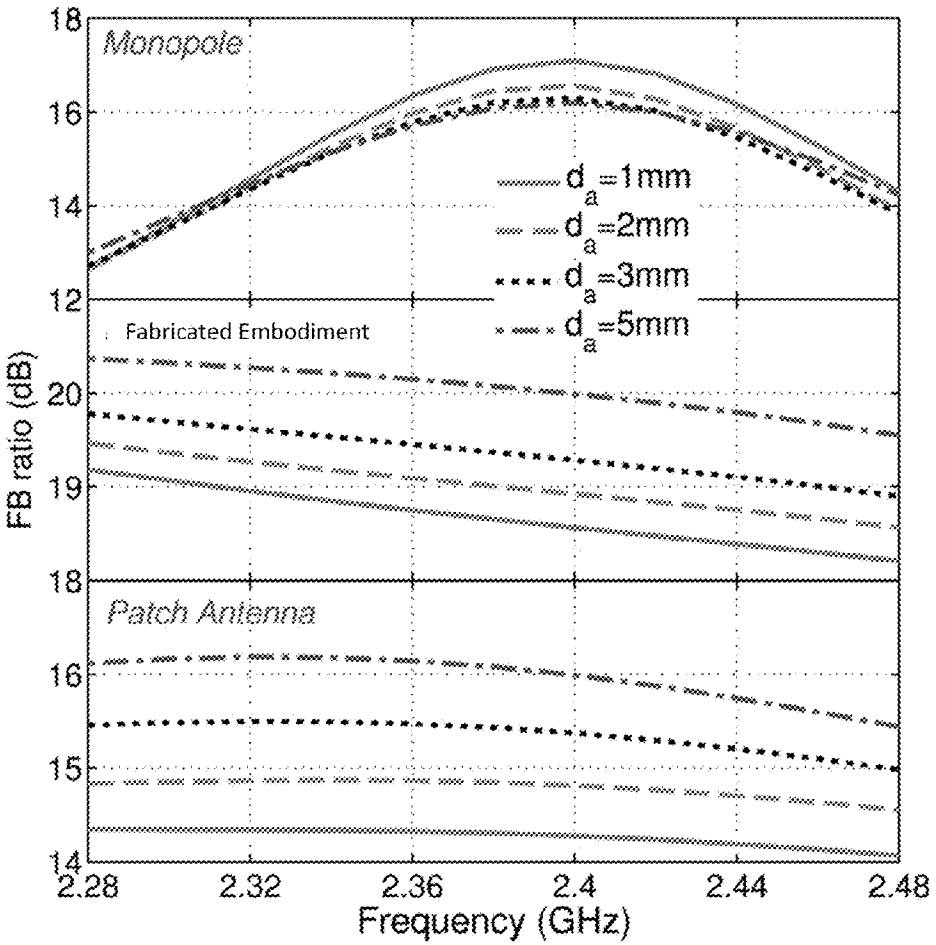
FIG. 13 is a graph illustrating the front-to-back ratio between an embodiment of our antenna, the reference patch antenna, and the planar monopole antenna.

We conducted further measurements and assessments of the embodiment of our fabricated antenna as may be appreciated from FIGS. 9-10 and the below Table 1, which compares performance of the exemplary embodiment we fabricated with other antennas that have been disclosed in the below identified references. In the below Table 1, the term "SOA" refers to "State of Art", the term "Embodiment" refers to our fabricated embodiment discussed above, and numbers 1-6 refer to the following.

[1] Wideband printed monopole antenna disclosed by M. N. Suma, P. C. Bybi, and P. Mohanan, *A Wideband Printed Monopole Antenna for* 2.45 *GHz WLAN Applications*, Microw. Opt. Technol. Lett., 48, 871 (2006);

[2] Inverted-F antenna disclosed by P. Salonen et al., *A Small Planar Inverted-F Antenna For Wearable Applications*, Wearable Compusters, (1999);

[3] Planar textile antenna disclosed in A. Tronquo et al., *Robust Planar Textile Antenna For Wireless Body LANs Operating in* 2.45 *GHz ISM Band*, Electron. Lett., 42, 142 (2006)

[4] Dual-band antenna disclosed in S. Zhu and R. Langley, *Dual-Band Wearable Textile Antenna On An EBG Substrate*, IEEE Trans. Ant. Propagat., 57, 926 (2009);

[5] Wearable textile antenna disclosed in R. Moro et al., *Wearable Textile Antenna In Substrate Integrated Waveguide Technology*, Electron. Lett., 48, 985 (2012); and

[6] AMC based antenna disclosed in H. R. Raad et al., *Flexible And Compact AMC Based Antenna For Telemedicine Applications*, IEEE Trans. Ant. Propagat., 61, 524 (2013).

TABLE 1

Performance comparison among various SOA wearable antennas at 2.4 GHz.

| | Foot Print ($\lambda^2$) | Gain (dBi) | FB Ratio (dB) | Height (mm) |
|---|---|---|---|---|
| Embodiment | 0.166 | 6.2 | 25 | 3.5 |
| [1] | 0.512 | 2.1 | 0 | 1.6 |
| [2] | 1.094 | — | — | 9.0 |
| [3] | 0.370 | 6.5 | 13 | 2.65 |
| [4] | 0.922 | 6.3 | 15 | 3.3 |
| [5] | 0.647 | 4.9 | 20 | 3.94 |
| [6] | 0.290 | 3.7 | 8 | 3.6 |

Figure 14:
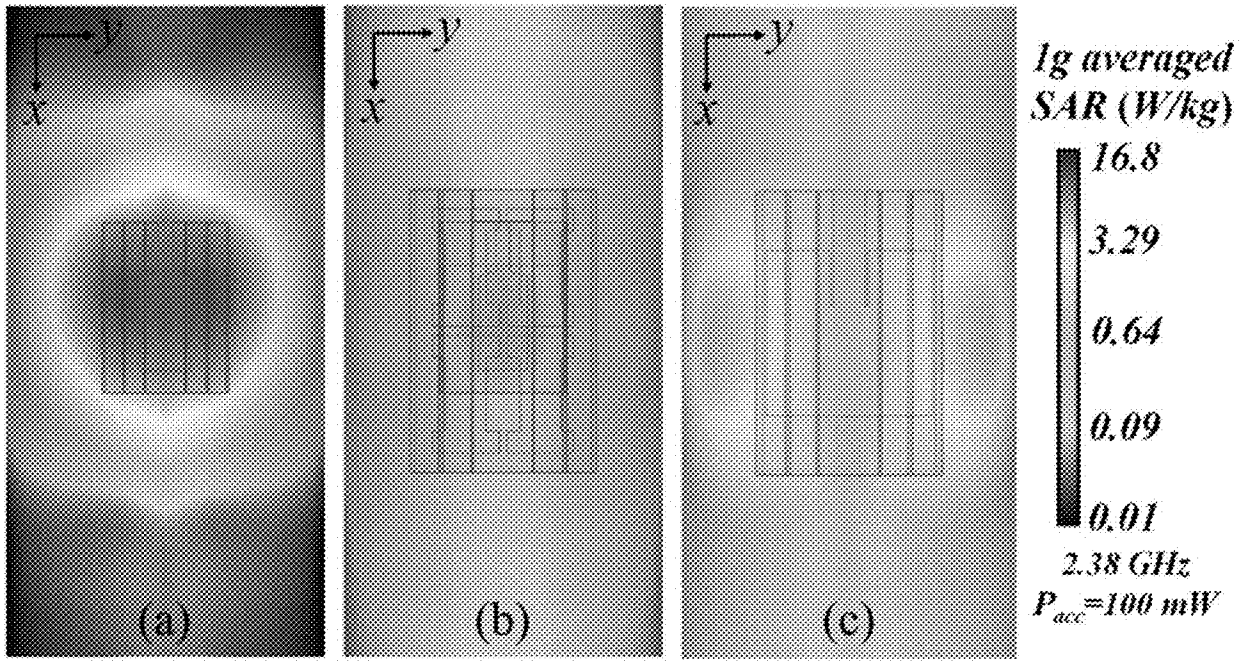
FIG. 14 is a specific absorption rate comparison of the embodiment of our antenna (b), the reference patch antenna (a), and the planar monopole antenna (c).

Additional testing of the fabricated version of an embodiment of our antenna was also performed, as may be appreciated from FIGS. 11-14. The fabricated embodiment of our antenna was compared to a conventional monopole antenna and a conventional reference patch antenna that were designed to resonate at 2.38 GHz. The reference patch antenna utilized a microstrip feed and had the same form factor as the fabricated embodiment of our antenna. FIGS. 11-14 illustrate the $S_{11}$, gain, and the FB ratio results from the different antennas when they were mounted onto a cylindrical multilayer human tissue model with a bending radius of 40 mm. FIG. 14 illustrates a SAR comparison that was performed among these three different antennas. For FIGS. 11-14, the antennas were placed a distance $d_a$ away from the tissue layer of the model (e.g. $d_a$ of 1 mm is 1 mm away from the layer, $d_a$ of 2 mm corresponds to the antenna being 2 mm away from the tissue layer, etc.). As can be appreciated from the results of FIGS. 11-14, the fabricated embodiment of our antenna has a robust input impedance even when it is placed in extremely close proximity (e.g. $d_a$—of 1 mm) to the multilayer tissue model. Bandwidth broadening for the fabricated embodiment of our antenna was also observed. For instance, a −10 dB bandwidth extending from 2.33-2.43 GHz to 2.31-2.47 GHz due to the decreased quality factor of the radiator caused by the lossy tissue model loading. This effect is somewhat comparable to what was observed with the reference patch antenna and was superior to the monopole antenna, which was found to be very sensitive to the distance it was positioned from the tissue layer. Further, the monopole antenna was found to have about 90% of its input power absorbed in the antenna near field by the skin and fat layers of the tissue and dissipated as heat.

The fabricated embodiment of our antenna was also found to have a stable gain that only decreased from 5.9 dBi to 5.8 dBi in the band of interest. In contrast, the reference patch antenna experiences a severe drop from 4.5 to 3.8 dBi, which was almost a 40-60% drop, which signifies that the fabricated embodiment of our antenna is able to maintain a good impedance match and high efficiency when positioned at various distances and, in particular, in very close proximity to human tissue as compared to a monopole antenna or conventional patch antenna. The FB ratios for the fabricated embodiment of our antenna also were relatively constant, with variations of smaller than 1.5 dB being observed. This performance was much better than the FB ratios found to exist with the reference path antenna, which experienced significantly more variation in the FB ratio.

The SAR comparison of FIG. 14 was performed utilizing a 100 mW power accepted by the antenna $P_{acc}$ at 2.38 GHz. As can be seen from FIG. 14, for the considered power input of 100 mW, the monopole antenna was found to generate a maximum of 1 g averaged SAR value of about 16.8 W/kg due to its omnidirectional radiation characteristic. Even at a distance of 5 mm away from the tissue model, the monopole experienced a maximum 1 g averaged SAR value as high as 11.3 W/kg. For the reference patch antenna, a maximum 1 g averaged SAR value was around 3.98 W/kg. In contrast, the fabricated embodiment of our antenna was found to have a 0.66 W/kg SAR when positioned only 1 mm away from the tissue, which provides a 95.3% reduction in the 1 g averaged SAR compared to the monopole antenna and an 83.4% reduction in the 1 g averaged SAR compared to the reference patch antenna. These results show that embodiments of our antenna provide surprising and substantially better performance than other conventional antennas when placed close to the body of an animal.

Figure 15B:
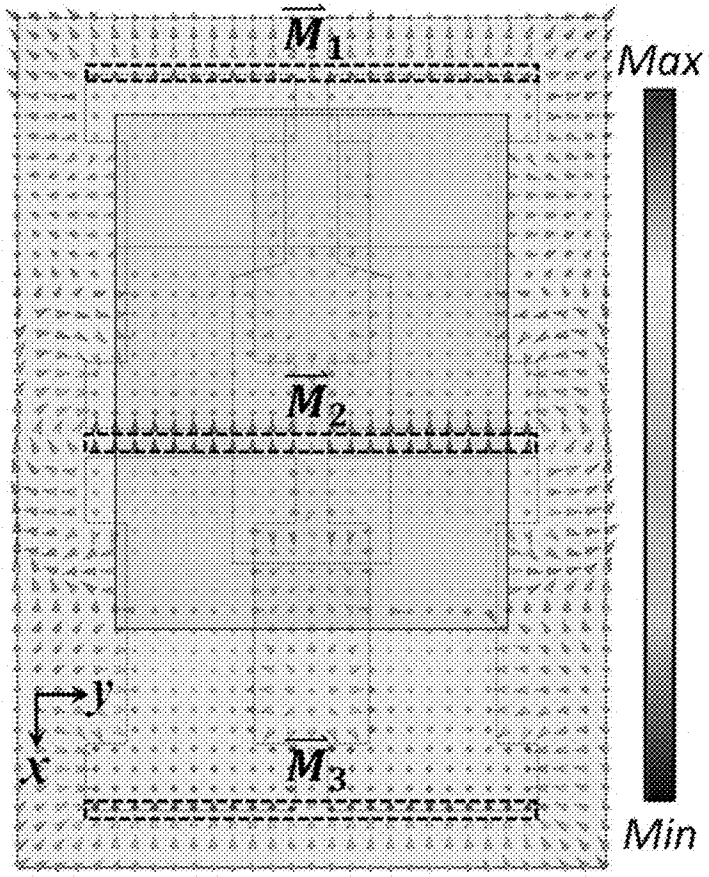
FIG. 15B is a schematic view of an embodiment of our antenna that illustrates a calculated radiation patter for the embodiment of our antenna shown in FIG. 15A.
Figure 15A:
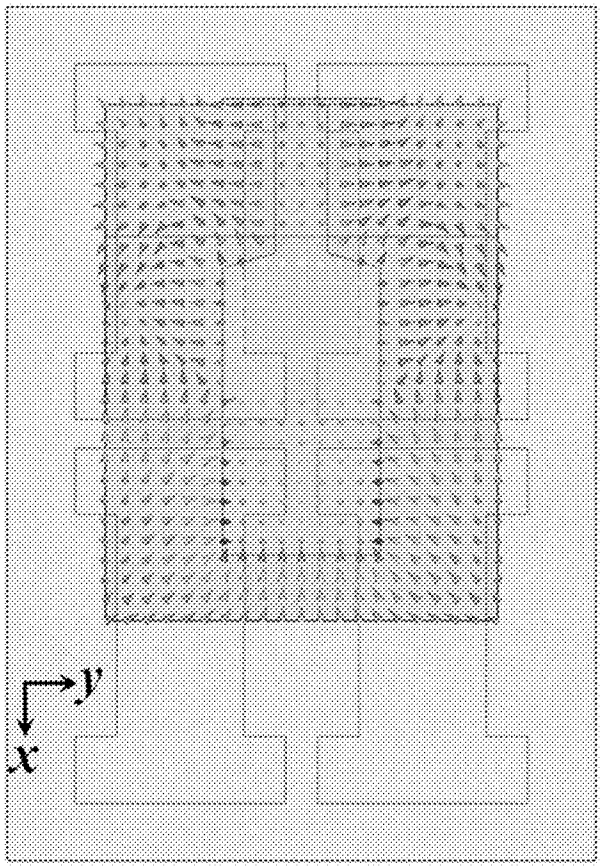
FIG. 15A is a schematic view of an embodiment of our antenna that illustrates fields at 2.38 GHz that are plotted for an embodiment of our antenna.

FIGS. 15A and 15B illustrate where electric fields at 2.38 GHz can be generated for an embodiment of our antenna. As can be seen from FIGS. 15A and 15B, the electric fields can be mainly concentrated in the periphery of the second section 2 and in the capacitive gaps between the resonators 5 along the x-direction. The second section can therefore be configured as an electric current source which has radiation that can be greatly suppressed near the first section 1. Gaps between the second section and the resonators 5 can behave like slot antennas, and can be considered as magnetic current sources as they are able to radiate efficiently even when at close proximity to the first section 1. The sized first section 1 can therefore act as a primary radiator to permit the antenna to operate like a three element slot array with amplitude tapering which provides for a high FB ratio in view of the compactness of the overall footprint an embodiment of the antenna can have.

Figure 16A:
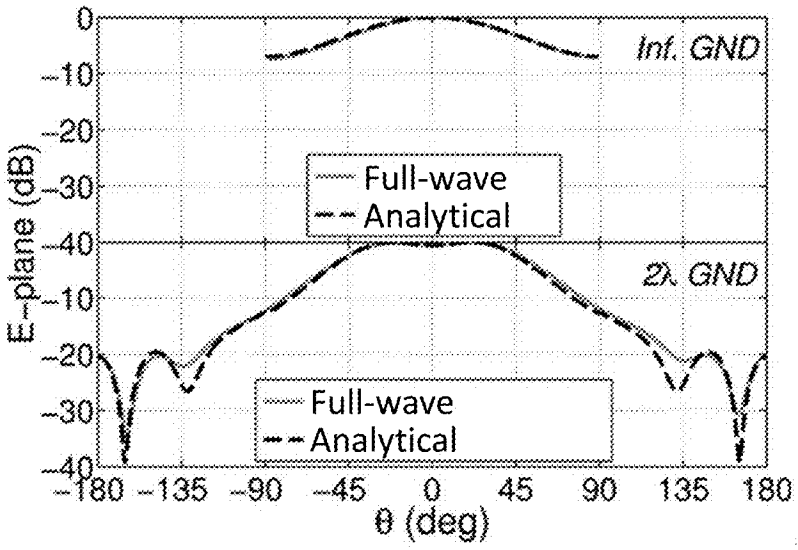
FIG. 16A illustrates full wave simulation results for an embodiment of our antenna and the analytical results of an array containing three non-uniform magnetic current sources in the E-plane.
Figure 16B:
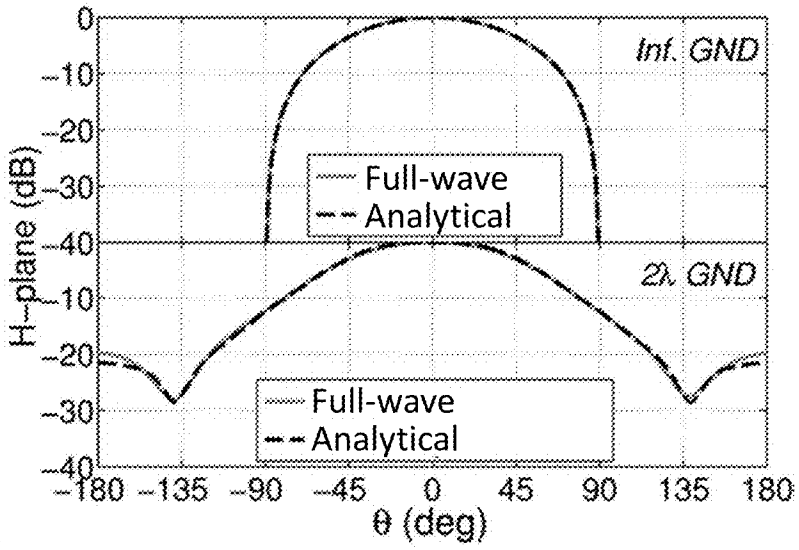
FIG. 16B illustrates full wave simulation results for an embodiment of our antenna and the analytical results of an array containing three non-uniform magnetic current sources in the H-plane.

FIGS. 16A and 16B illustrate calculated radiation patterns of an array of the three uniform equivalent magnetic densities $\vec{M}_1$, $\vec{M}_2$, $\vec{M}_3$ that are oriented in the width direction (e.g. the y direction) for the first section 1 of an embodiment of the antenna. The geometrical theory of diffraction (GTD) technique was employed to account for the edge diffraction of the first section 1 of the antenna. In the E-plane (i.e. the x-z plane), the total far-field radiation patter results from the superposition of the direct geometrical optics (GO) fields produced by each of the three magnetic current sources and the double diffracted fields were also taken into account. In the H-plane (i.e. the x-z plane) the far-field contribution provided by the direct GO fields is the same from each magnetic current source. Instead of a zero contribution of the first order diffraction due to the vanishing electric field at the edges, the slop diffraction was also accounted for. In the backlobe region of the H-plane, the contribution from the E-plane edge diffraction was obtained by use of the equivalent edge current technique.

FIGS. 16A and 16B illustrate results from full wave simulations of an embodiment of our antenna on both a finite ground plane with a size of 2λ by 2λ (2λ GND) and an infinite ground plane (Inf. GND) and compared the results to those obtained from analytical formals. For these simulations, the geometric dimensions in the current source array model were determined from the actual geometrical dimensions of the fabricated embodiment of our antenna. As can be seen from FIGS. 16A and 16B, there is good correspondence, which verifies that the radiation from embodiments of our antenna is primarily emitted from the first section rather than the second section. Radiation from the second section 2 is mainly cancelled by first section 1. The first section can therefore be configured to act as both a high impedance reflector for the antenna and the metasurface property of the first section 1 can also be configured to operate as a main radiator of the antenna while simultaneously providing an isolation functionality for when the antenna is located in very close proximity to another object (e.g. within 1 mm of the body of an animal).

Figure 17:
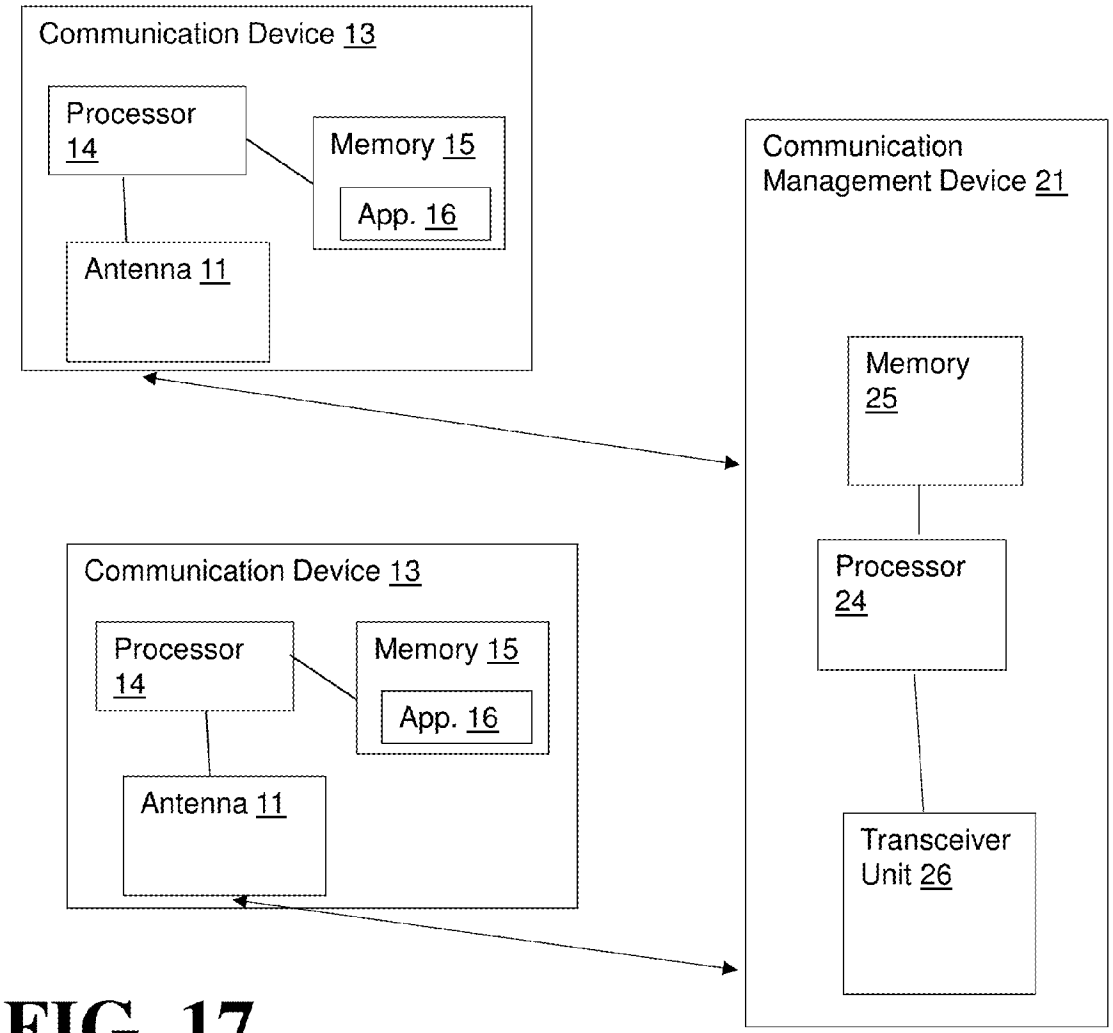
FIG. 17 is a block diagram of an exemplary communication system that has multiple devices utilizing embodiments of the antenna.

It is contemplated that embodiments of our antenna may be utilized in communication devices and within a communication system. FIG. 17 illustrates one such system in which communication devices 13 each include at least one embodiment of our antenna 11 that is communicatively connected to a processor 14. The processor 14 is communicatively connected to non-transitory memory 15 such as flash memory, a hard drive, or other type of memory. The memory 15 may have one or more applications stored thereon such as App. 16. The communication devices 13 may be, for example, measuring devices that measure a parameter such as blood flow, material content within blood, respiration, respiration rate, heart rate, or other parameter of a human patient or animal. The communication devices could also be a beeper, or a wireless monitor, a wearable radio, or a wireless electronic device that includes one or more sensors or detectors that is attachable to a garment to be worn by a user or includes a strap or other attachment device for being worn by a user. The processor may be any of a number of hardware processor elements or interlinked processors such as a microprocessor, any type of Intel® Pentium® processor, a central processing unit or any other type of hardware processor.

The communication devices may also have a number of input devices and output devices communicatively connected to the processor or memory of the communication device. For instance, sensors, detectors, a keyboard, or a button may be communicatively connected to the processor 14. In some embodiments, one or more sensors or detectors or other type of measuring devices may be connected to the processor 14. The communication devices 13 may each also include a strap or other attachment mechanism by which the communication device is able to be releasably attached to a human or garment that is worn by a human.

The communication devices 13 may communicate via the antenna 11 with a communication management device 21, which may be a base station, an access point, a workstation, a desktop computer, a server, or other computer device that may communicate with the communication devices to facilitate a network connection to other computer devices or that may directly receive data from the communication devices 13.

The communication management device 21 may have non-transitory memory, a processor 24 and a transceiver unit 26. The communication management device 21 may communicate via wireless communications to the communication devices via the transceiver unit 26 and antennas 11 of the communication devices 13. Radio frequency links may be established between the transceiver unit 26 and antennas 11, for example, to communicatively connect the communication management device 21 to the communication devices 13.

The communication management device 21 may receive measurement data from the one or more communication devices and store that data in its memory 25 for storage and subsequent use to monitor a patient, person, being monitored by the communication device 13 or communication management device 21. For example, the received data may be stored in a database stored within memory 25 of the communication management device 21 or within a computer device that is communicatively connected to the communication management device 21. In other embodiments, the communication management device may forward the received data to another device that collects such data to perform monitoring of a person or a condition being monitored, measured or sensed by the communication device 13.

The environment in which embodiments of our antenna can be used can include indoor and outdoor locations such as hospitals, hospices, personal houses, apartments, work places, factories, conference centers, shopping malls, gardens, parking lots, and battlefields.

It should be appreciated that different design changes may be made to the above discussed embodiments of our antenna and communication system. For instance, metallic vias can be used as an alternative to the above noted artificial ground planes. Metallic vias can be added to connect the metasurface patterns to the solid ground plane, which can provide additional inductance that is helpful in reducing the overall profile of the antenna even further. For instance, the vias may be embedded in the first section 1 of the antenna as vertical wire segments that connect metallic patches to the ground plane to provide electrical connections between the metasurface and the ground plane. As another example, any of a number of different power sources may be used to provide power to the antenna and any of a number of different interfaces may be utilized to transmit signals to and from the antenna to a processor connected to the antenna. As yet another example, some embodiments of our antenna may be configured for use in connection with any of a number of different pre-selected band ranges. For example, some embodiments of our antenna can be configured to operate in a band that is between 2.36 and 2.4 GHz, other embodiments may be configured to operate at a pre-selected band that is entirely below 2.36 GHz and yet other embodiments may be configured to operate at a pre-selected band that is entirely above 2.4 GHz While certain present preferred embodiments of our antenna and communication systems, and embodiments of methods for making and using the same have been shown and described above, it is to be distinctly understood that the invention is not limited thereto but may be otherwise variously embodied and practiced within the scope of the following claims.

We claim:

1. An antenna for a communication device comprising:

a first body;

a spacer adjacent to the first body;

a second body adjacent to the spacer such that the spacer is between the first and second bodies, the second body configured as a monopole, the second body having a perimeter that is smaller than a perimeter of the first body;

the first body configured as an artificial metasurface ground plane (AMSGP) having resonators backed by a metallic sheet, the metallic sheet configured as the ground plane of the AMSGP, the AMSGP configured as a primary radiator that operates as a slot array with amplitude tapering.

2. The antenna of claim 1 wherein the AMSGP is configured to reflect and radiate while simultaneously isolating the antenna from an animal body to which the antenna is attachable such that radiation to be emitted from the antenna is substantially directed away from the metallic sheet of the antenna and away from the animal body.

3. The antenna of claim 2 wherein the resonators are I-shaped resonators.

4. The antenna of claim 1 wherein the first body is flexible.

5. The antenna of claim 1 wherein the second body is flexible.

6. The antenna of claim 1 wherein the first body and second body are both planar structures.

7. The antenna of claim 1 wherein a first side of the first body is attached to the spacer and a first side of the second body is attached to the spacer.

8. The antenna of claim 7 wherein the spacer has a first side and a second side opposite the first side and wherein the first side of the first body is attached to the first side of the spacer and the first side of the second body is attached to the second side of the spacer.

9. The antenna of claim 8 wherein the spacer is a foam spacer and the first side of the first body is spaced apart from the first side of the second body by at least 0.1 mm and a plurality of vias are embedded in the first body to electrically connect an artificial metasurface of the AMSGP to the metallic sheet of the AMSGP.

10. A communication system comprising:

a communication management device communicatively connectable to at least one communication device;

wherein each of the at least one communication device is comprised of:

a processor communicatively connected to non-transitory memory;

an antenna communicatively connected to the processor for establishing a radio frequency link to the communication management device, the antenna comprising:

a first body;

a spacer adjacent to the first body;

a second body adjacent to the spacer such that the spacer is between the first and second bodies, the second body configured as a monopole, the second body having a perimeter that is smaller than a perimeter of the first body;

the first body configured as an artificial metasurface ground plane (AMSGP) having resonators backed by a metallic sheet, the metallic sheet configured as the ground plane of the AMSGP, the AMSGP configured as a primary radiator that operates as a slot array with amplitude tapering.

11. The communication system of claim 10 wherein the communication management device is a server, a workstation, a desktop computer, an access point, or a base station.

12. The communication system of claim 10 wherein the communication management device is comprised of a processor communicatively connected to non-transitory memory and a wireless transceiver unit for forming the radio frequency link with the antenna of the communication device.

13. The communication system of claim 10 wherein the communication system is within a healthcare facility and the radio frequency link is within a frequency band of between 2360-2400 MHz.

14. The communication system of claim 10 wherein the antenna establishes or maintains the radio frequency link with the communication management device when the communication device is worn by an animal.

15. The communication system of claim 14 wherein the animal is a human.

16. The communication system of claim 10 wherein the spacer is a foam spacer.

17. The communication system of claim 10 wherein the first body is spaced apart from the second body by at least 0.1 mm.

18. The communication system of claim 17 wherein a first side of the first body is attached to the spacer and a first side of the second body is attached to the spacer.

19. The communication system of claim 18 wherein the spacer has a first side and a second side opposite the first side and wherein the first side of the first body is directly attached to the first side of the spacer and the first side of the second body is directly attached to the second side of the spacer; and wherein the spacer is sized and configured such that the first side of the first body is spaced apart from the first side of the second body by at least 0.1 mm.

20. The communication system of claim 19 wherein the AMSGP is configured to reflect and radiate while simultaneously isolating an animal body to which the antenna is attachable from the antenna.

* * * * *